US008047542B2

(12) United States Patent
Hara et al.

(10) Patent No.: US 8,047,542 B2
(45) Date of Patent: Nov. 1, 2011

(54) PRINTING APPARATUS CAPABLE OF HANDLING PAPER SIZE ERROR

(75) Inventors: Masashi Hara, Ibaraki-ken (JP); Tatsunori Kaneko, Ibaraki-ken (JP); Atsushi Roppongi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 118 days.

(21) Appl. No.: 12/453,041

(22) Filed: Apr. 28, 2009

(65) Prior Publication Data

US 2009/0278304 A1 Nov. 12, 2009

(30) Foreign Application Priority Data

May 8, 2008 (JP) ..... P2008-122350

(51) Int. Cl.
*B65H 5/34* (2006.01)

(52) U.S. Cl. ..... 271/270; 271/265.01; 271/265.02

(58) Field of Classification Search ..... 271/265.02, 271/270

See application file for complete search history.

(56) References Cited

U.S. PATENT DOCUMENTS 4,579,444 A * 4/1986 Pinckney et al. ..... 399/372
5,467,182 A * 11/1995 Hower et al. ..... 399/364
5,689,795 A * 11/1997 Mastrandrea ..... 399/407
5,839,015 A * 11/1998 Faguy et al. ..... 399/23
6,247,695 B1 * 6/2001 Linder et al. ..... 271/265.04

FOREIGN PATENT DOCUMENTS

JP 11-65370 A 3/1999

* cited by examiner

*Primary Examiner* — Stefanos Karmis
*Assistant Examiner* — Howard Sanders
(74) *Attorney, Agent, or Firm* — The Nath Law Group; Jerald L. Meyer; Robert T. Burns

(57) ABSTRACT

In a printing apparatus, even when the measured paper size differs from the scheduled size, it is possible to reduce the frequency of requiring a recovery procedure, and prevent the productivity from decreasing by continuing the operation of the printing apparatus as much as possible. The printing apparatus includes a paper feeding unit for feeding a print sheet from a paper feed tray 120, 130*a*, 130*b*, 130*c* or 130*d* to a transportation route CR through a paper feed route FR, in-tray sensors 182, 183*a*, 183*b* . . . for measuring the paper size in the paper feed trays; a transportation sensor 181 for measuring the paper size on the transportation route, a transportation operation adjusting unit 332 for adjusting the transportation operation on the transportation or paper feed route according to the measurement result of the transportation sensor 181 when the measurement results of the transportation sensor 181 and in-tray sensors mismatch.

3 Claims, 6 Drawing Sheets

PRINTING APPARATUS CAPABLE OF HANDLING PAPER SIZE ERROR

BACKGROUND OF THE INVENTION

1. Field of the Invention

The present invention relates to a printing apparatus capable of forming images on print sheets transported on transportation routes, and particularly relates to a printing apparatus capable of handling paper size error.

2. Description of the Background Art

Conventionally, when a printing apparatus such as an ink jet printer transports print sheets, the interval between adjacent print sheets is determined on the basis of the size information of print sheets stored in a paper feed tray. The size of print sheets stored in the paper feed tray is determined with reference to the output of a sensor (for example, potentiometer sensor, reflective sensor, a photo-interrupter sensor or the like), and thereby non-standard size print sheets may not be accurately determined. If a print sheet of a size which is different from that as determined is transported, the next print sheet is transported thereafter in accordance with the scheduling arranged on the basis of the misdetermination so that paper jam may occur. There are print systems which simply determine the size of print sheets on the basis of the size information which is input through a panel or the like. In such systems, the possibility of misdetermining the paper size is increased.

Japanese Patent Published Application No. Hei 11-65370 discloses an image forming apparatus in which the above shortcoming can be solved. In the case of this image forming apparatus, the image forming operation is halted to avoid printing failure when operation mistake relating to the setting of print sheets in a paper feed cassette is detected by determining disagreement between the paper size which is designated by the user and the paper size which is actually transported from a paper feed tray.

However, in the case of the printing apparatus as described in Japanese Patent Published Application No. Hei 11-65370, when there is a disagreement between the result of paper size determination and the paper size as designated by the user, the image forming operation is always halted even if the print process can be continued by adjusting the image forming operation, the subsequent paper feeding timing and so forth. Accordingly, there is a problem that, even when only a minimum operational error occurs, the normal operation state has to be recovered by performing a predetermined recovering procedure which is troublesome to lower the productivity.

On the other hand, in recent years, a printing apparatus capable of improving the productivity during double-side printing has been developed. This printing apparatus is provided with a sheet reversing route and a scheduling function for improving the performance of double-side printing by inserting a print sheet, which has been printed on its main side and has been reversed upside down, between adjacent print sheets to be printed on their main sides for successively conducting the print process on main sides and the print process on back sides. In such a printing apparatus, when the above disagreement is detected, the productivity is substantially reduced.

Namely, in the printing apparatus provided with the sheet reversing route and capable of conducting the scheduling for improving the productivity during double-side printing, the paper feeding operations has to be performed at appropriate feeding intervals which are determined in accordance with the sizes of the respective print sheets to be printed in order to maintain the productivity. The feeding intervals are determined with reference to the size information of the print sheets stored in the paper feed tray, so that if a print sheet differing in size is accidentally transported, the print process is mistiming the back side printing operations. Since a print sheet which is reversed with the back side up is inserted between adjacent print sheets to be printed on their main sides in accordance with the scheduling, a number of print sheets to be controlled by the scheduling are adversely affected by misdetermination and paper jam which may occur due to the above described mistiming during the back side printing operations.

SUMMARY OF THE INVENTION

Taking into consideration the above circumstances, it is an object of the present invention to provide a printing apparatus capable of forming images on print sheets transported on transportation routes, wherein even when a print sheet having a correct size which is scheduled is not fed, it is possible to reduce the frequency of requiring a recovery procedure due to erroneous operation, and prevent the productivity from decreasing by adjusting the transportation operation and the image forming operation to continue the operation of the printing apparatus as much as possible.

In order to accomplish the object as described above, a printing apparatus which forms images on a surface of a print sheet transported on a transportation route by an image forming unit, the printing apparatus comprises: a paper feeding unit operable to feed a print sheet from a paper feed tray to the transportation route through a paper feed route; a first paper size determination unit operable to measure the size of print sheets stored in the paper feed tray; a second paper size determination unit operable to measure the size of a print sheet which is being transported on the transportation route or the paper feed route; and a transportation operation adjusting unit operable to adjust the operation of transporting a print sheet on the transportation route or the paper feed route on the basis of the measurement result of the second paper size determination unit when the measurement result of the second paper size determination unit differs from the measurement result of the first paper size determination unit.

In accordance with the present invention as recited in the above, it is possible to avoid paper jam during transportation, and continue the print process without compromising the productivity by determining the size of a print sheet during transportation, and adjusting the transportation operation, that is, for example, performed by correcting the interval between this print sheet and the subsequent print sheet which may already be transported.

Preferably, in the invention as described above, a resist unit is located at a junction point between the transportation route and the paper feed route, and the transportation operation adjusting unit is provided with an acceleration/deceleration drive unit operable to accelerate and decelerate the transportation of the print sheet between the resist unit and the paper feed route, and correct the intervals between print sheets on the transportation route or the paper feed route by the use of the acceleration/deceleration drive unit.

In this case, even after starting the transportation of print sheets, the interval between a preceding print sheet and a subsequent print sheet can be corrected by accelerating or decelerating the transportation of the subsequent print sheet.

Preferably, in the invention as described above, the transportation route is an annular route comprising: a basic transportation route which is extending from the junction point to a paper discharge route through the image forming unit; and a sheet reversing route which is connected to the basic transportation route as a branch to receive the print sheet from the basic transportation route, and reverse the print sheet upside down by reciprocating in the sheet reversing route and returning to the basic transportation route, wherein the transportation operation adjusting unit is provided with a reversing operation control unit operable to adjust the time required for performing the reversing operation on the reversing route to correct the intervals between print sheets on the transportation route.

In this case, the interval between a preceding print sheet and a subsequent print sheet is corrected by accelerating or decelerating the transportation speed, while performing scheduling for improving the productivity during double-side printing by inserting a print sheet, which has been printed on its main side and has been reversed upside down through the reversing route, between adjacent print sheets to be printed on their main sides for successively conducting the print process on main sides and the print process on back sides.

Preferably, in the invention as described above, the transportation route is an annular route comprising: a basic transportation route which is extending from the junction point to a paper discharge route through the image forming unit; and a sheet reversing route which is connected to the basic transportation route as a branch to receive the print sheet from the basic transportation route, and reverse the print sheet upside down by reciprocating in the sheet reversing route and returning to the basic transportation route, wherein the transportation route is an annular route comprising: a basic transportation route which is extending from the junction point to a paper discharge route through the image forming unit; and a sheet reversing route which is connected to the basic transportation route as a branch to receive the print sheet from the basic transportation route, and reverse the print sheet upside down by reciprocating in the sheet reversing route and returning to the basic transportation route, wherein the transportation operation adjusting unit is provided with a reversing operation control unit operable to adjust the time required for performing the reversing operation on the reversing route to correct the intervals between print sheets on the transportation route.

In this case, the transportation operation in the reversing route for reversing the print sheet upside down is controlled to compensate the delay of transportation due to the stay time in a drying space which is adjusted on the basis of a paper size which is erroneously determined, and minimize the decrease in manufacturing efficiency.

Preferably, in the invention as described above, the transportation operation adjusting unit halts the transportation operation in response to the setting manipulation of the user in accordance with the measurement result of the second paper size determination unit and the measurement result of the first paper size determination unit.

In this case, for example, when the size difference is too large to correct the transportation operation by the above transportation operation adjusting process, the transportation operation is halted, followed by prompting to perform an ordinary recovery procedure.

Preferably, in the invention as described above, the transportation operation adjusting unit halts the image forming process of the image forming unit and discharges the print sheet in response to the setting manipulation of the user in accordance with the measurement result of the second paper size determination unit and the measurement result of the first paper size determination unit.

In this case, when the print process cannot be performed but paper transportation is possible, for example, because the paper size is excessively small, the print process is halted followed by discharging the print sheet so that an unnecessary trouble recovery procedure can be avoided.

Preferably, in the invention as described above, the transportation operation adjusting unit selects and performs either one of the operational mode of halting the transportation operation or the operational mode of halting the image forming process and discharging the print sheet in response to the setting manipulation of the user on the basis of the measurement result of the second paper size determination unit and the measurement result of the first paper size determination unit. In this case, only appropriate modes of the available modes are given to the user as options in accordance with the needs of the user to prevent execution of an inappropriate print process which is not intended by the user.

In accordance with the present invention, for a printing apparatus capable of forming images on print sheets transported on transportation routes, even when a print sheet having a correct size which is scheduled is not fed, it is possible to reduce the frequency of requiring a recovery procedure due to erroneous operation, and prevent the productivity from decreasing by adjusting the transportation operation and the image forming operation to continue the operation of the printing apparatus as much as possible.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

In the following description, an embodiment of the present invention will be explained in conjunction with the accompanying drawings.

(Overall Configuration of Printing Apparatus)

Figure 1:
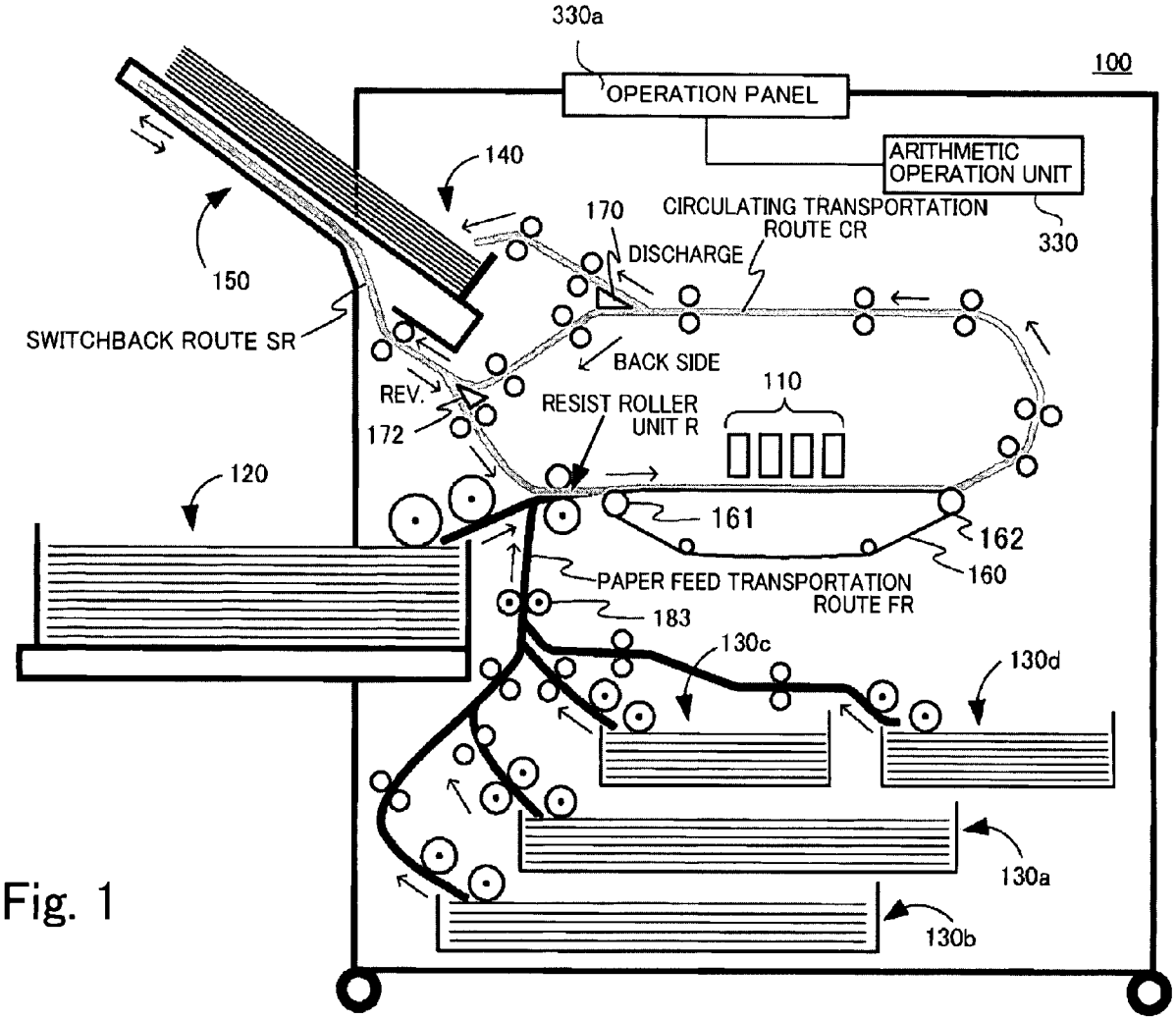
FIG. 1 is a schematic diagram for showing a printing apparatus in accordance with an embodiment of the present invention.

The first embodiment of the present invention will be explained with reference to the drawing. FIG. 1 is a schematic diagram for showing a print sheet transportation route of a printing apparatus 100 in accordance with the present embodiment.

As shown in FIG. 1, the printing apparatus 100 is provided with a paper feed mechanism for feeding print sheets including a paper feed side tray 120 exposed from the side surface of the housing of the printing apparatus 100, a plurality of paper feed trays 130*a*, 130*b*, 130*c* and 130*d* which are located inside the housing. Furthermore, a discharge port 140 is provided as a discharge mechanism for discharging print sheets which have been printed.

In the case of the present embodiment, the printing apparatus 100 is a line color inkjet printer provided with a plurality of ink heads each of which is elongated in the width direction of the print sheet and provided with a number of nozzles. The respective inkheads eject black or color inks respectively in order to print images of the respective colors on a line-by-line basis to overlap each other.

A print sheet fed from either the paper feed side tray 120 or one of the paper feed trays 130 is transported along a paper feed transportation route FR by rollers or another transportation mechanism to a resist roller unit R which defines a reference position at which the leading edge of each print sheet is aligned. The head unit 110 having a plurality of print heads are located in the downstream side of the paper transportation route as seen from the resist roller unit R. The print sheet is printed to form an image with ink ejected from the respective print heads on a line-by-line basis, while being transported at a predetermined speed on a conveyor belt 160 which is located on the opposite side to the print heads 110.

The print sheet which has been printed is transported in the housing by the transportation mechanism such as rollers. In the case of the one-side printing process for printing only one side of the print sheet, the print sheet is transferred to the discharge port 140 and stacked on a catch tray 150 as a receiver at the discharge port 140 with the printed side down. The catch tray 150 is provided to protrude from the housing with a certain thickness. The catch tray 150 is slanted with a lower upright wall at which print sheets discharged from the discharge port 140 are automatically aligned under their own weight.

In the case of the double-side printing process for printing both sides of the print sheet, the print sheet is not transferred to the discharge port 140 after printing the main side (the first printed side is called "main side", and the next printed side is called "back side" in this description), but is transported in the housing. Because of this, the printing apparatus 100 is provided with a shunt mechanism 170 for selectively switching the transfer route for printing on the back side. After printing on the main side, the shunt mechanism 170 transfers the print sheet to a switchback route SR such that the print sheet is reversed with respect to the transportation route by the switchback operation. The print sheet transferred from a circulating transportation route CR is reversed in this switchback route SR by reciprocating in the switchback route SR and returning to the circulating transportation route CR as a switchback operation. The print sheet is transferred to the resist roller unit R again by the transportation mechanism such as roller units through a switching mechanism 172, and printed on the back side in the same manner as on the main side. After printing on the back side, the print sheet with images printed on the both sides is transferred to the discharge port 140, and stacked on the catch tray 150 serving as the receiver at the discharge port 140.

Incidentally, in the case of the present embodiment, the switchback operation is performed in the double-side print mode by the use of the space formed in the catch tray 150. The space formed in the catch tray 150 is designed such that the print sheet cannot be accessed externally during the switchback operation. By this configuration, it is avoided that a user extracts the print sheet during the switchback operation by mistake. On the other hand, since the catch tray 150 is indispensable for the printing apparatus 100, there is no need for a separate space, which would be particularly provided in the printing apparatus 100 for the switchback operation, while making use of the space formed in the catch tray 150 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

In the double-side print mode of the printing apparatus 100, the print sheet is transferred to the resist roller unit R, which defines the reference position at which the leading edge of the print sheet is aligned, not only before printing the main side thereof but also before printing the back side. Because of this, just before the resist roller unit R, there is a junction point between the transportation route for the print sheet just fed from the paper feed side tray and the transportation route for transporting the print sheet with the main side having been printed.

Figure 2:
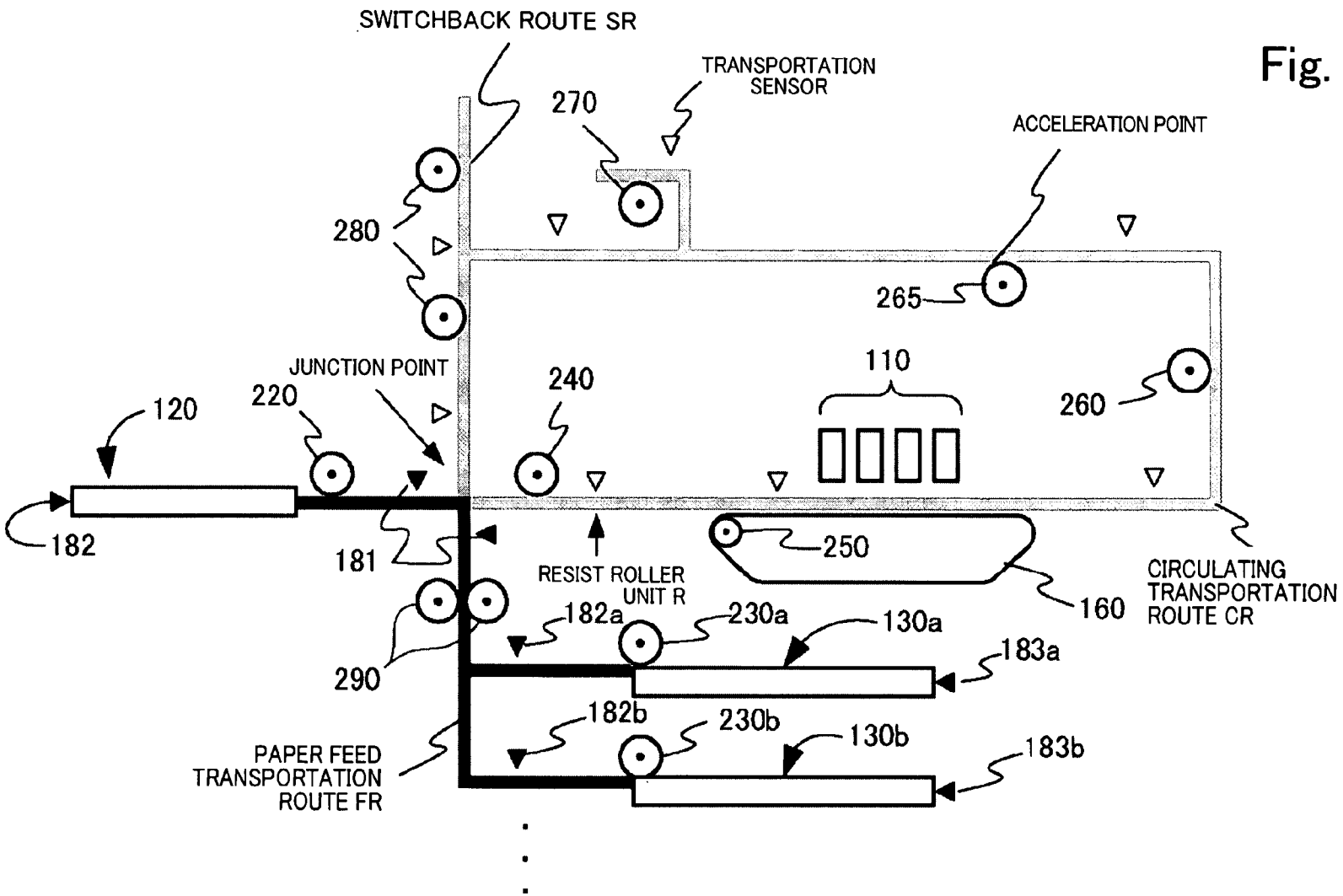
FIG. 2 is a diagram for schematically showing the transportation routes of the printing apparatus in accordance with the embodiment.

The paper transportation route is divided into the paper feed transportation route FR, which is located on the paper feed mechanism side as seen from this junction point, and the remaining transportation route which is referred to herein as the circulating transportation route CR. FIG. 2 is a diagram for schematically showing the paper feed transportation route FR, the circulating transportation route CR, and the switchback route SR. Some of roller units forming the transportation mechanism are not illustrated for the sake of clarity in explanation.

The paper feed transportation route FR is provided with a side paper feed drive unit 220 for feeding paper from the paper feed side tray 120, and a first tray drive unit 230*a*, a second tray drive unit 230*b*, . . . respectively for feeding paper from the paper feed trays 130*a*, 130*b*, 130*c* and 130*d*. These drive units serves as a paper feeding unit in combination for transferring print sheets to the resist roller unit R. In addition to this, the paper feed side tray 120 and the paper feed trays 130*a*, 130*b*, 130 *c* and 130*d* are provided within-tray sensors 182, 183*a*, 183*b* . . . respectively each of which serves as a first paper size determination unit for measuring the size of print sheets stored in the tray. These in-tray sensors 182, 183*a*, 183*b* . . . may be, for example, a potentiometer (resistance) detector or sensor which is provided for a partition slidably located in the tray.

Each drive unit (the first tray drive unit 230*a*, the second tray drive unit 230*b* or the like) on the paper feed transportation route FR as described above comprises a transportation mechanism constructed by a plurality of rollers to extract print sheets one after another from the paper feed tray corresponding thereto and transfer the print sheets to the resist roller unit R. The respective transportation units can be driven independently from each other, and perform necessary operation in order to implement the paper feed mechanism.

Particularly, in the case of the present embodiment, the driving mechanism of the paper feed transportation route FR is provided with a drive roller unit 290 which serves as an acceleration/deceleration drive unit for accelerating or decelerating the transportation of a print sheet on the paper feed transportation route FR between the resist roller unit R and the paper feed transportation route FR.

In addition, the paper feed transportation route FR is provided with a plurality of transportation sensors with which paper jam can be detected along the paper feed transportation route FR. Each transportation sensor is a sensor which can determine if a print sheet is present and detect the leading edge of the print sheet. For example, the plurality of transportation sensors are located in appropriate positions of the paper feed transportation route at appropriate intervals such that paper jam can be detected if the transportation sensor located on the transportation side does not detect the print sheet a predetermined time after the transportation sensor located on the paper feeding side detects the print sheet.

Of the transportation sensors, there are transportation sensors 181 which are located in the upstream side of the resist roller unit R for transferring print sheets, and function as a second paper size determination unit which measures the paper size of the print sheet being transported. For example, the transportation sensors 181 are used to measure the size of the print sheet which is being transported on the basis of the transportation speed and the transit time of the print sheet, and determine paper jam (paper feeding error) if the transportation sensors 181 does not detect a print sheet within a predetermined time after driving the side paper feed drive unit 220, the first tray drive unit 230*a*, and the like.

The circulating transportation route CR is the annular circulating transportation route on which each print sheet is printed. The circulating transportation route CR is provided with a resist drive unit 240 for leading a print sheet to the resist roller unit R, a belt drive unit 250 for driving the conveyor belt 160 which is located in a position opposite the head unit 110, first and second upper side transportation drive units 260 and 265 which are arranged on the circulating transportation route CR successively in the paper transportation direction, an upper side paper discharge drive unit 270 for transferring a printed sheet to the discharge port 140, and a switchback route drive unit 280 for drawing the printed sheet in the switchback route SR, reversing and transferring the printed sheet to the junction point between the circulating transportation route CR and the paper feed transportation route FR. Each of these transportation units is provided with a driving mechanism comprising one or more roller units, and serves to transport print sheets one after another along the transportation route. The respective transportation units can be driven independently from each other, and perform necessary operation in accordance with the transportation position of the print sheet.

The circulating transportation route CR is also provided with a plurality of transportation sensors with which paper jam can be detected along the circulating transportation route CR. Furthermore, it can be confirmed that each print sheet is transferred to the resist roller unit R in an appropriate manner. By providing the transportation sensor near each driving unit in the circulating transportation route CR, it is possible to determine which drive unit has caused the paper jam along the circulating transportation route CR.

The switchback route SR is connected to the circulating transportation route CR as a branch, and serves as a reversing route and a transportation mechanism for receiving a print sheet from the circulating transportation route CR, moving the print sheet backwards and forwards (switchback motion), and returning the print sheet to the circulating transportation route CR in order to reverse the print sheet. In addition, this switchback route SR can transport a print sheet at a different speed than the circulating transportation route CR, accelerate or decelerate the print sheet which is transferred from the circulating transportation route CR, and shorten or extend the hold time during switchback operation.

Furthermore, in the case of the present embodiment, the print process can be successively performed at predetermined intervals in accordance with scheduling by feeding a print sheet, and feeding a next print sheet in advance of printing and discharging the preceding print sheet, rather than feeding a print sheet, waiting for discharging this print sheet, and then feeding a next print sheet.

Figure 5A:
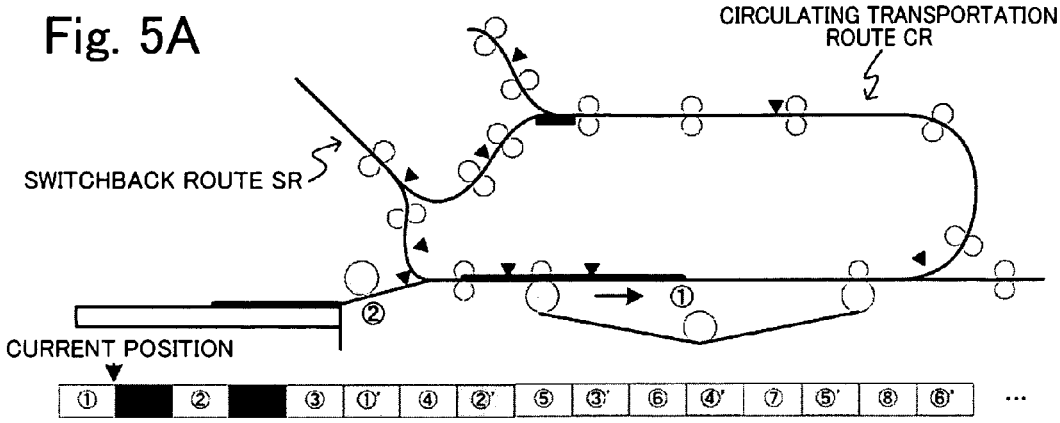
FIG. 5 is an explanatory view for showing the basic scheme of the scheduling for the printing apparatus in accordance with the embodiment.
Figure 5B:
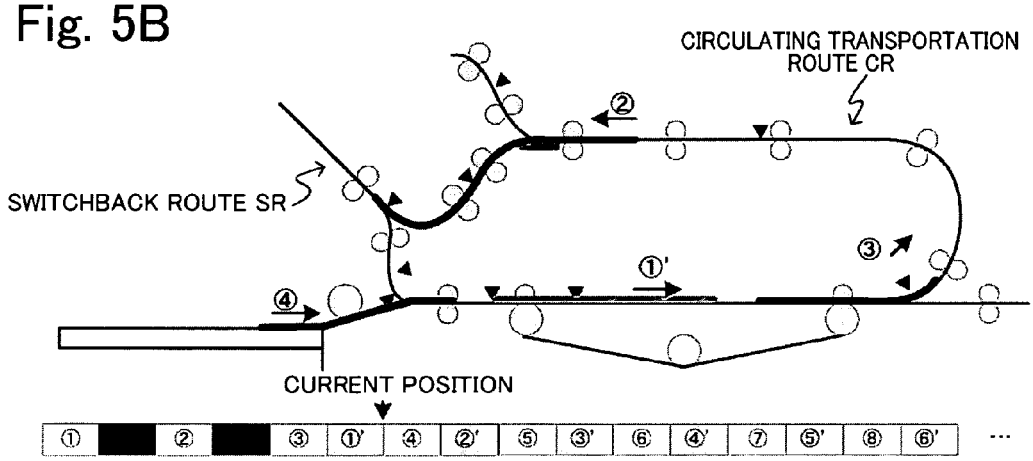
Figure 5C:
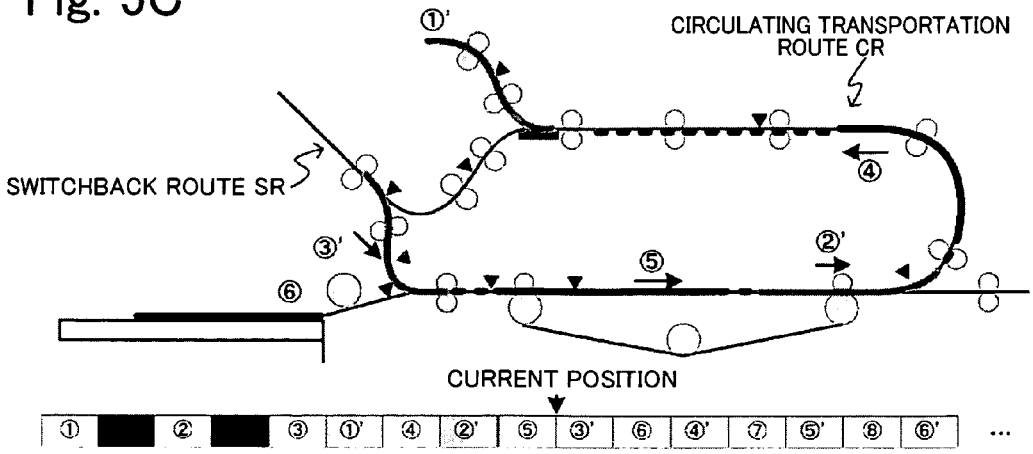

More specifically speaking, in the case of the double-side printing process of this embodiment, as illustrated in FIGS. 5A through 5C, a print sheet is printed on its main side by the head unit 110 (FIG. 5A), circulated by the circulating transportation route CR, reversed upside down through the switchback route SR, returned to the head unit 110 (FIG. 5B), printed on its back side, and discharged (FIG. 5C). In this double-side printing process, as illustrated in FIG. 5B, the print sheet ①' reversed upside down through the switchback route SR is inserted between the print sheet ③ and the print sheet ④ which are to be printed on their main sides.

Accordingly, in accordance with normal scheduling for double-side printing, a print sheet to be printed its main side is fed in order that a space is provided in front of this print sheet for giving way to the print sheet returned from the switchback route SR. By this space, in accordance with the present embodiment, it is possible to successively perform the print process on main sides and the print process on back sides and secure a ½ productivity as compared with one-side printing.

The conveyor belt 160 is located between and running around a driving roller 161 and a driven roller 162 located in a position opposite the head unit 110, and rotates about them in the clockwise direction as seen in the figure. The head unit 110 includes four ink heads of yellow (Y), magenta (M), cyan (C), and black (K) which are arranged over the upper surface of the conveyor belt 160 along the moving direction thereof, And located opposite the conveyor belt 160 to form a color image by superimposing four monochromatic images on the print sheet.

Meanwhile, as shown in FIG. 1, the printing apparatus 100 is provided with an arithmetic operation unit 330. This arithmetic operation unit 330 is an arithmetic operation module composed of hardware elements, for example, processor(s) such as a CPU and a DSP (Digital Signal Processor), a memory, and other necessary electronic circuits, and software (and/or firmware) for implementing necessary functions in combination with the hardware. Several function modules can be virtually implemented by the software for performing the processes of handling image data, controlling the operations of the respective units, and performing a variety of processes in response to the manipulation by the user. In addition, this arithmetic operation unit 330 is connected to an operation panel 330*a*, through which the arithmetic operation unit 330 can receive commands and settings from the user.

(Configuration of Arithmetic Operation Unit)

The transportation operation adjusting process in accordance with the present invention is performed by the arithmetic operation unit 330 which controls the operations of the head unit 110, the respective drive motors, and drive units such as switching devices for driving the transfer mechanism.

Figure 3:
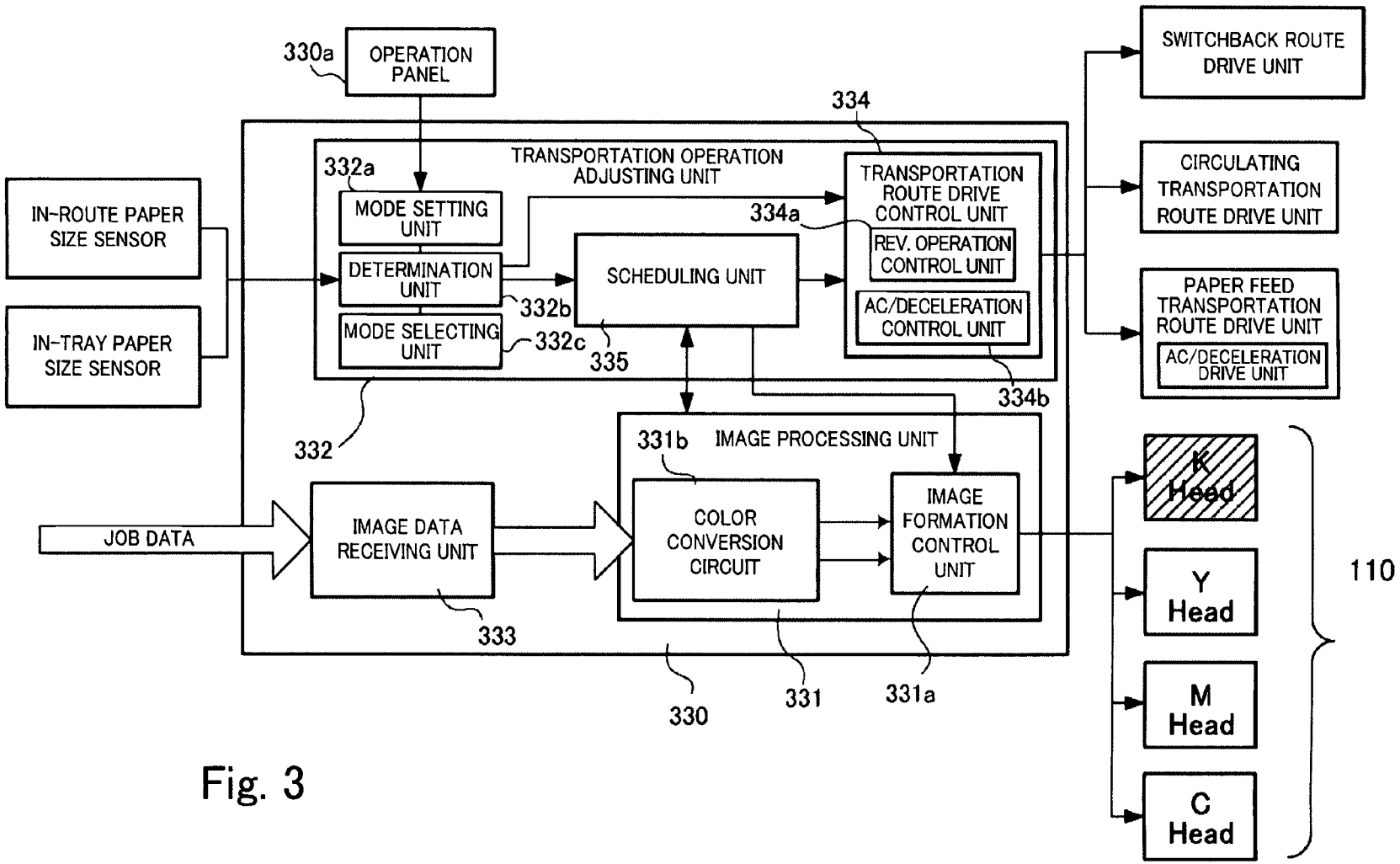
FIG. 3 is a block diagram showing a function module implemented within the arithmetic operation unit for performing a decurling process of the printing apparatus in accordance with the embodiment.

FIG. 3 is a block diagram showing a function module implemented within the arithmetic operation unit 330 for performing the transportation operation adjusting process. As shown in FIG. 3, the arithmetic operation unit 330 includes a transportation operation adjusting unit 332, an image data receiving unit 333 and an image processing unit 331, and the transportation operation adjusting unit 332 includes a transportation route drive control unit 334 and the scheduling unit 335.

The image data receiving unit 333 is a communication interface for receiving job data, and serves as a module for transferring image data contained in the received job data to the image processing unit 331.

The image processing unit 331 is an arithmetic processing unit for performing digital signal processes specialized for processing images, and serves as a module for performing image conversion and other necessary processes and performing print processes. This image processing unit 331 is provided with an image formation control unit 331*a*, and a color conversion circuit 331*b*.

The image formation control unit 331*a* is a module for controlling the overall image forming process by controlling the operations of the ink heads of the respective colors and the driving means along the transportation route, and performing the image forming process in regard to the speeds and timings on the basis of the schedule of the scheduling unit 335. The color conversion circuit 331*b* is a circuit for converting an RGB print image into a CMYK print image, and the image formation control unit 331*a* performs a print process on the basis of the print images for the respective colors.

On the other hand, the transportation operation adjusting unit 332 is a module for adjusting the transportation operation on the paper feed transportation route FR or the circulating transportation route CR on the basis of the result of measuring the paper size by the transportation sensors 181 when the measurement result of the in-tray sensors 182, 183*a*, 183*b* . . . (the first paper size determination unit) differs from the measurement result of the transportation sensors 181 (the second paper size determination unit). Specifically speaking, the transportation operation adjusting unit 332 is provided with a mode setting unit 332*a*, a determination unit 332*b* and a mode selecting unit 332*c*. The mode setting unit 332*a* is a module for receiving a manipulation signal from the user through the operation panel 330*a*, and setting a transportation operation adjusting mode on the basis of the user's manipulation, and the mode setting unit 332*a* analyzes the manipulation signal as received and outputs a mode selection condition corresponding to the user's manipulation to the mode selecting unit 332*c*.

The determination unit 332*b* is a module for comparing the measurement result of the in-tray sensors 182, 183*a*, 183*b* . . . with the measurement result of the transportation sensors 181, and determining whether to perform the transportation operation adjusting process. This determination unit 332*b* sets up a threshold value for use in the determination process in accordance with the mode which is selected by the setting manipulation through the mode setting unit 332*a*. When this determination unit 332*b* determines that the transportation operation adjusting process is to be performed, the mode selecting unit 332*c* is controlled to select an appropriate mode. The mode selecting unit 332*c* outputs operational instructions to the relevant modules in accordance with the mode selected by the setting manipulation performed through the mode setting unit 332*a*.

As described above (refer to FIG. 5), the scheduling unit 335 is a module for determining the order, timings and speeds relating to the feeding, image forming and transportation operations of print sheets to be printed on the main sides and print sheets reversed upside down after leaving the sheet reversing route, i.e., the switchback route SR. In addition to this, the scheduling unit 335 is also provided with the functionality of correcting the interval between adjacent print sheets by adjusting the order, timings and speeds relating to the feeding, image forming and transportation operations of the respective print sheets.

The transportation route drive control unit 334 is a transportation control module for controlling the transportation operation along the circulating transportation route CR, the paper feed transportation route FR and the switchback route SR in accordance with the schedule of the scheduling unit 335 with reference to the result of determination by the determination unit 332*b*.

The transportation route drive control unit 334 of the present embodiment is provided with a reversing operation control unit 334*a* for adjusting the time required for performing the reversing operation on the switchback route SR, and an acceleration/deceleration control unit 334*b* for controlling the drive roller unit 290 which is an acceleration/deceleration drive unit in order to accelerate or decelerate the transportation speed of a print sheet on the paper feed transportation route FR. The reversing operation control unit 334*a* controls the reversing operation by changing the waiting time in the switchback route SR, the transportation speed after reversing the print sheet, the variation of the acceleration during reversing in accordance with the result of determination by the determination unit 332*b* or the schedule of the scheduling unit 335.

Figure 6:
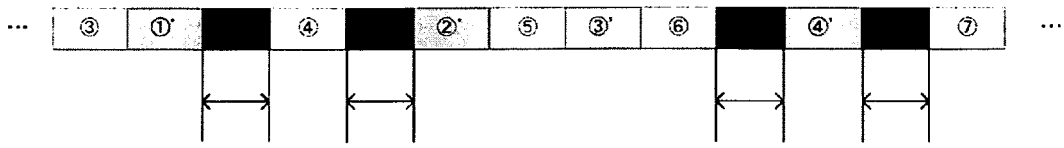
FIG. 6 is an explanatory view for showing the scheme of the scheduling for the printing apparatus in accordance with the embodiment when performing the decurling process.

Also, as illustrated in FIG. 6, the scheduling unit 335 and the transportation route drive control unit 334 serve to perform a decurling process by increasing the intervals between print sheets during the paper feeding operation, and adjusting the transportation speed during double-side printing, the transfer of each print sheet in the sheet reversing route (the switchback route), the waiting time (stopping time) in the switchback route SR, the warp amount of each print sheet and so forth in order to secure a ½ productivity during double-side printing as compared with one-side printing.

More specifically described, the transportation operation adjusting process is performed to correct the intervals between print sheets on the transportation routes by accelerating or decelerating the speed of feeding the print sheets by the drive roller unit 290 which is the acceleration/deceleration drive unit. In this case, after comparing the paper size (setting size) measured by the in-tray sensor with the measured size (actual size) of the print sheet being transported, if it is determined that the actual size is greater than the setting size, the transportation of the next print sheet is decelerated, and if it is determined that the actual size is smaller than the setting size, the transportation of the next print sheet is accelerated.

The amount of correction varies depending upon the difference between the setting size and the actual size. The deceleration process is shown in Table 1 (in units of milliseconds) when the actual size is greater than the setting size. Also, the acceleration process is shown in Table 2 (in units of milliseconds) when the actual size is smaller than the setting size.

TABLE 1

| | | | Actual Time ② (Unit: ms) Interval During One Side Printing | | | | |
|---|---|---|---|---|---|---|---|
| | | | A4 (Horizontal) 375 | B5 (Vertical) 446 | A4 (Vertical) 506 | B4 607 | A3 691 |
| Set Time ① (Unit: ms) | B5 (Horizontal) | 333 | 42 | 113 | 173 | 274 | 358 |
| | A4 (Horizontal) | 375 | — | 71 | 131 | 232 | 316 |
| | B5 (Vertical) | 446 | — | — | 60 | 161 | 245 |
| | A4 (Vertical) | 506 | — | — | — | 101 | 185 |
| | B4 | 607 | — | — | — | — | 84 |

As shown in Table 1, for example, when the setting size is B5 (Horizontal) and the actual size is A4 (Horizontal), the transportation of the print sheet is decelerated in order that the print sheet arrives at the resist roller unit R after 42 milliseconds delay.

TABLE 2

| | | Actual Time ② (Unit: ms) Interval During One Side Printing | | | | |
|---|---|---|---|---|---|---|
| | | A4 (Horizontal) 333 | B5 (Vertical) 375 | A4 (Vertical) 446 | B4 506 | A3 607 |
| | | Size Error Detection Time | | | | |
| | | 375.75 | 410.75 | 469.5 | 519.5 | 603.25 |
| Set Time ① (Unit: ms) | A4 (Horizontal) | 43 | — | — | — | — |
| | B5 (Vertical) | 43 | 36 | — | — | — |
| | A4 (Vertical) | 43 | 36 | 24 | — | — |
| | B4 | 43 | 36 | 24 | 14 | — |
| | A3 | 43 | 36 | 24 | 14 | —4 |

On the other hand, for example, when the setting size is A3 and the actual size is A4 (Horizontal), the transportation of the next print sheet is started just after detecting the actual size and accelerated in order that the print sheet arrives at the resist roller unit R 36 milliseconds earlier as shown in Table 2.

(Transportation Operation Adjusting Process)

Figure 4:
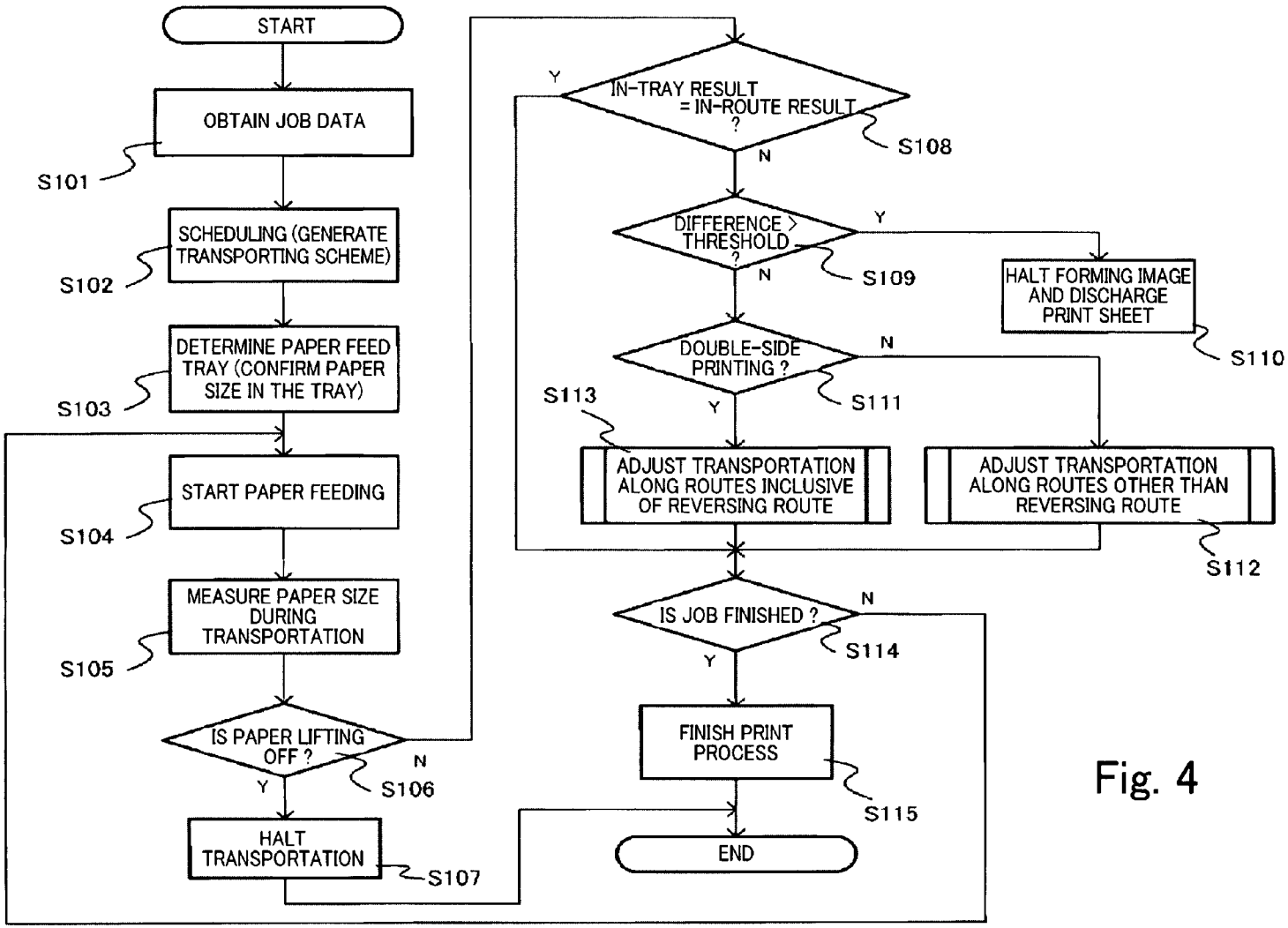
FIG. 4 is a flow chart for showing the operation of the printing apparatus in accordance with the embodiment when performing the decurling process.

A transportation operation adjusting process can be performed by operating the printing apparatus having the structure as described above as follows. FIG. 4 is a flow chart for showing the operation of the printing apparatus in accordance with the present embodiment when performing the transportation operation adjusting process.

First, when job data is received, image data is acquired in step S101. The image data is handled by the image processing unit 331 and color converted by the color conversion circuit 331*b*, and transportation scheduling is performed in accordance with the job context in step S102. Then, after selecting an appropriate paper feed tray in accordance with the paper size which is designated in the job data, the size of the print sheets stored in the selected paper feed tray is measured in step S103, followed by starting feeding print sheets in accordance with the schedule in step S104.

While the first print sheet is transported, the paper size thereof is measured in step S105, and it is detected if the print sheet is lifting off in advance of reaching the image forming site. If it is detected that the print sheet is lifting off (i.e., the "Y" branch from step S106), the transportation operation is halted in step S107, and the subsequent steps are not performed to terminate the process. On the other hand, if it is detected that the print sheet is not lifting off (i.e., the "N" branch from step S106), the print process is continued to compare the measurement result of the in-tray sensors 182, 183*a*, 183*b* . . . and the measurement result of the transportation sensors 181 in step S108. When the measurement result of the in-tray sensors 182, 183*a*, 183*b* . . . matches the measurement result of the transportation sensors 181 (i.e., the "Y" branch from step S108), the transportation operation is not changed, and the steps S104 to S114 are repeated with each print sheet which is fed a new, until the job has been completed (i.e., the "N" branch from step S114).

On the other hand, when the measurement result of the in-tray sensors 182, 183*a*, 183*b* . . . does not match the measurement result of the transportation sensors 181 (i.e., the "N" branch from step S108), the difference therebetween is compared with a threshold value in step S109. If the difference is greater than the threshold value (i.e., the "Y" branch from step S109), the image forming process is aborted to discharge the print sheet as it is in step S110. Conversely, if the difference is not greater than the threshold value (i.e., the "N" branch from step S109) so that the transportation operation can be corrected, the transportation operation is adjusted in steps S111 to S113 in accordance with whether or not the print process is a double-side printing process. Namely, if the print process is not a double-side printing process (i.e., the "N" branch from step S111), the transportation operation is adjusted along the routes other than the switchback route in step S112. If the print process is a double-side printing process (i.e., the "Y" branch from step S111), the transportation operation is adjusted along the routes inclusive of the switchback route in step S113.

Specifically, when the transportation operation is adjusted along the routes other than the switchback route SR, the scheduling unit 335 regenerates the schedule for adjusting the order, timings and speeds relating to the feeding, image forming and transportation operations of print sheets in the routes other than the switchback route SR in order to correct the intervals between print sheets. The transportation route drive control unit 334 controls the transportation operation along the circulating transportation route CR, the paper feed transportation route FR and the switchback route SR in accordance with the schedule as regenerated.

On the other hand, when the transportation operation is adjusted along the routes inclusive of the switchback route SR, the time required for performing the reversing operation is adjusted in addition to the transportation operation adjustment along the routes other than the switchback route SR. Specifically describing, the reversing operation control unit 334*a* controls the reversing operation by changing the waiting time in the switchback route SR, the transportation speed after reversing the print sheet, the variation of the acceleration during reversing in accordance with the result of determination by the determination unit 332*b* or the schedule of the scheduling unit 335.

Figure 7:
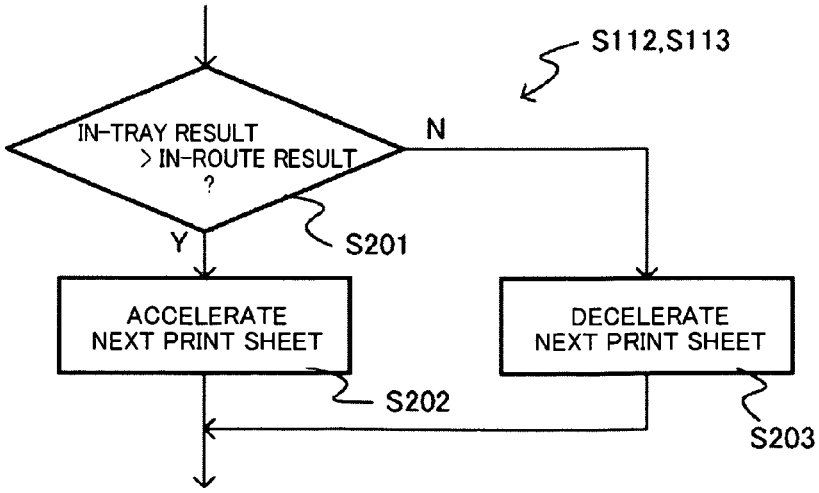
FIG. 7 is a flow chart for showing the operation of acceleration and deceleration when performing the decurling process of the printing apparatus in accordance with the embodiment.

Furthermore, if necessary, the acceleration/deceleration control unit 334*b* corrects the intervals between print sheets on the transportation routes by accelerating or decelerating the speed of feeding the print sheets by the drive roller unit 290 which is the acceleration/deceleration drive unit in step S112 or S113 as shown in FIG. 7. For example, after comparing the paper size (setting size) measured by the in-tray sensor with the measured size (actual size) of the print sheet being transported, if it is determined that the actual size is greater than the setting size (i.e., the "N" branch from step S201), the transportation of the next print sheet is decelerated in step S203, and if it is determined that the actual size is smaller than the setting size (i.e., the "Y" branch from step S201), the transportation of the next print sheet is accelerated in step S202.

When all the print sheets relating to the job have been processed (i.e., the "Y" branch from step S114) the print process is finished in step S115.

MODIFICATION EXAMPLES

In the case of the above embodiment, the transportation operation adjusting mode is automatically selected in step S109 on the basis of the result of comparison between the differential measurement and the threshold value. However, the present invention is not limited thereto. For example, one of the modes as described above may be selected and performed in response to user operation. In this case, only appropriate modes of the available modes are given to the user as options in accordance with the needs of the user to prevent execution of an inappropriate print process which is not intended by the user.

(Actions and Effects)

In accordance with the present embodiment as has been discussed above, it is possible to avoid paper jam during transportation, and continue the print process without compromising the productivity by determining the size of a print sheet during transportation, and adjusting the transportation operation, that is, for example, performed by correcting the interval between this print sheet and the subsequent print sheet which may already be transported.

In the case of the present embodiment, the drive roller unit 290 is provided for correcting the intervals between print sheets by accelerating or decelerating the transportation of print sheets on the paper feed transportation route FR, and even after starting the transportation of print sheets, the interval between a preceding print sheet and a subsequent print sheet can be corrected by accelerating or decelerating the transportation of the subsequent print sheet.

Also, the scheduling unit 335 is provided for correcting the intervals between print sheets by determining the order, timings and speeds relating to the feeding, image forming and transportation operations of print sheets to be printed on the main sides and print sheets reversed upside down after leaving the sheet reversing route, i.e., the switchback route SR. This scheduling unit 335 is used to correct the interval between a preceding print sheet and a subsequent print sheet by accelerating or decelerating the transportation speed, while performing scheduling for improving the productivity during double-side printing by inserting a print sheet, which has been printed on its main side and has been reversed upside down through the switchback route SR, between adjacent print sheets to be printed on their main sides for successively conducting the print process on main sides and the print process on back sides.

Particularly, in the case of the present embodiment, there is the reversing operation control unit 334*a* for controlling the transportation operation in the switchback route SR. The reversing operation control unit 334*a* is used to adjust the time required for performing the reversing operation on the switchback route SR, and correct the intervals between print sheets on the transportation routes. It is therefore possible to cover the delay of transportation due to the stay time in a drying space which is adjusted on the basis of a paper size which is erroneously determined, and minimize the decrease in manufacturing efficiency.

Furthermore, in the case of the present embodiment, the transportation operation is halted depending upon the size difference obtained by comparing the measurement result of the in-tray sensors 182, 183*a*, 183*b* . . . with the measurement result of the transportation sensors 181. For example, when the size difference is too large to correct the transportation operation by the above transportation operation adjusting process, the transportation operation is halted, followed by prompting to perform an ordinary recovery procedure. Also, in the case of the present embodiment, when the print process cannot be performed but paper transportation is possible, for example, because the paper size is excessively small, the print process is halted followed by the print sheet is discharged so that an unnecessary trouble recovery procedure can be avoided.

As a result, for the printing apparatus in accordance with the present embodiment capable of forming images on print sheets transported on transportation routes, even when a print sheet having a correct size which is scheduled is not fed, it is possible to reduce the frequency of requiring a recovery procedure due to erroneous operation, and prevent the productivity from decreasing by adjusting the transportation operation and the image forming operation to continue the operation of the printing apparatus as much as possible.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A printing apparatus which forms images on a surface of a print sheet transported on a transportation route by an image forming unit, the printing apparatus comprising:

a paper feeding unit operable to feed a print sheet from a paper feed tray to the transportation route through a paper feed route;

a first paper size determination unit operable to measure the size of print sheets stored in the paper feed tray;

a second paper size determination unit operable to measure the size of a print sheet which is being transported on the transportation route or the paper feed route; and a transportation operation adjusting unit operable to adjust an operation of transporting a print sheet on the transportation route or the paper feed route on the basis of a measurement result of the second paper size determination unit and continue the operation of transporting the print sheet by performing an operation of correcting an interval between print sheets when the measurement result of the second paper size determination unit differs from a measurement result of the first paper size determination unit, wherein a resist unit is located at a junction point between the transportation route and the paper feed route, and wherein the transportation operation adjusting unit is provided with an acceleration/deceleration drive unit operable to accelerate and decelerate the transportation of a print sheet between the resist unit and the paper feeding unit, and correct an interval between print sheets on the transportation route or the paper feed route by the use of the acceleration/deceleration drive unit.

2. A printing apparatus which forms images on a surface of a print sheet transported on a transportation route by an image forming unit, the printing apparatus comprising:

a paper feeding unit operable to feed a print sheet from a paper feed tray to the transportation route through a paper feed route;

a first paper size determination unit operable to measure the size of print sheets stored in the paper feed tray;

a second paper size determination unit operable to measure the size of a print sheet which is being transported on the transportation route or the paper feed route; and a transportation operation adjusting unit operable to adjust an operation of transporting a print sheet on the transportation route or the paper feed route on the basis of a measurement result of the second paper size determination unit and continue the operation of transporting the print sheet by performing an operation of correcting an interval between print sheets when the measurement result of the second paper size determination unit differs from a measurement result of the first paper size determination unit, wherein the transportation route is an annular route comprising:

a basic transportation route which is extending from a junction point between the transportation route and the paper feed route to a paper discharge route through the image forming unit; and a sheet reversing route which is connected to the basic transportation route as a branch to receive a print sheet from the basic transportation route, and reverse the print sheet upside down by reciprocating in the sheet reversing route and returning to the basic transportation route, wherein the transportation operation adjusting unit is provided with a scheduling unit operable to determine, during an image forming process, the order, timings and speeds relating to feeding, image forming and transportation operations of print sheets to be printed on the main sides and print sheets reversed upside down after leaving the sheet reversing route, and corrects an interval between print sheets by adjusting the order, timings and speeds relating to feeding, image forming and transportation operations of print sheets by the use of the scheduling unit.

3. A printing apparatus which forms images on a surface of a print sheet transported on a transportation route by an image forming unit, the printing apparatus comprising:

a paper feeding unit operable to feed a print sheet from a paper feed tray to the transportation route through a paper feed route;

a first paper size determination unit operable to measure the size of print sheets stored in the paper feed tray;

a second paper size determination unit operable to measure the size of a print sheet which is being transported on the transportation route or the paper feed route; and a transportation operation adjusting unit operable to adjust an operation of transporting a print sheet on the transportation route or the paper feed route on the basis of a measurement result of the second paper size determination unit and continue the operation of transporting the print sheet by performing an operation of correcting an interval between print sheets when the measurement result of the second paper size determination unit differs from a measurement result of the first paper size determination unit, wherein the transportation route is an annular route comprising:

a basic transportation route extending from a junction point between the transportation route and the paper feed route to a paper discharge route through the image forming unit; and a sheet reversing route which is connected to the basic transportation route as a branch to receive the print sheet from the basic transportation route, and reverse the print sheet upside down by reciprocating in the sheet reversing route and returning to the basic transportation route, wherein the transportation operation adjusting unit is provided with a reversing operation control unit operable to adjust the time required for performing the reversing operation on the reversing route to correct an interval between print sheets on the transportation route.

* * * * *